US005794500A

United States Patent [19]

Long et al.

[11] Patent Number: 5,794,500

[45] Date of Patent: Aug. 18, 1998

[54] APPARATUS AND METHOD FOR SLITTING THIN WEBS

[75] Inventors: Michael Long, Rochester; James Arthur White, Conesus, both of N.Y.

[73] Assignee: Eastman Kodak Company, Rochester, N.Y.

[21] Appl. No.: 777,108

[22] Filed: Dec. 31, 1996

Related U.S. Application Data

[63] Continuation of Ser. No. 335,535, Nov. 7, 1994, abandoned.

[51] Int. Cl.[6] ..... B26D 1/03; B26D 7/08; B26D 7/26

[52] U.S. Cl. ..... 83/22; 83/24; 83/100; 83/152; 83/156; 83/402; 83/425.4; 83/436.3; 83/505; 83/582; 83/955

[58] Field of Search ..... 83/22, 24, 56, 83/98, 99, 100, 152, 402, 425.2, 425.3, 425.4, 505, 582, 679, 955, 856, 858, 156, 436.3

[56] References Cited

U.S. PATENT DOCUMENTS

| | | | |
|---|---|---|---|
| 1,155,727 | 10/1915 | Harwood . | |
| 1,863,619 | 6/1932 | Cameron | 83/505 |
| 2,506,445 | 5/1950 | Donning | 164/61 |
| 2,538,972 | 1/1951 | Magnani | 164/76 |
| 2,552,674 | 5/1951 | Haren | 164/89 |
| 3,695,131 | 10/1972 | Zimmermann | 83/56 |
| 3,747,449 | 7/1973 | Gould | 83/22 |
| 4,041,816 | 8/1977 | Shearon | 83/100 |
| 4,094,217 | 6/1978 | Exline | 83/582 |
| 4,168,643 | 9/1979 | Takimoto et al. | 83/422 |
| 4,245,530 | 1/1981 | Frye et al. | 83/99 |
| 4,422,359 | 12/1983 | Leboeuf | 83/858 X |
| 4,512,226 | 4/1985 | Juckett | 83/56 |
| 4,671,155 | 6/1987 | Goldinger | 83/425.2 |
| 4,674,380 | 6/1987 | Hecht et al. | 83/425.2 |
| 4,693,157 | 9/1987 | Looser | 83/955 X |
| 4,693,784 | 9/1987 | Aula et al. | 83/100 |
| 4,819,528 | 4/1989 | Chadwick | 83/425.4 |
| 4,823,665 | 4/1989 | Cavagna | 83/856 X |
| 4,831,909 | 5/1989 | Peters et al. | 83/425.4 |
| 4,892,243 | 1/1990 | Long et al. | 226/97 |
| 4,989,487 | 2/1991 | Staley | 83/506 |
| 4,998,685 | 3/1991 | Distefano et al. | 226/95 |
| 5,367,934 | 11/1994 | MacNiel | 83/425.2 |
| 5,516,221 | 5/1996 | Lake | 83/425.3 X |

FOREIGN PATENT DOCUMENTS

| | | |
|---|---|---|
| 643816 | 5/1964 | Belgium . |
| 1030369 | 5/1966 | United Kingdom . |

*Primary Examiner*—Eugenia Jones
*Assistant Examiner*—Charles Goodman
*Attorney, Agent, or Firm*—Mark G. Bocchetti

[57] ABSTRACT

Knives (28, 30, 122) are held in tangential, resilient (106, 108) or fixed (132, 136) contact with a surface of an air bar (12–20) or air table (142); so that a web (26) moving on a cushion of air (46) over the air bar or table is cleanly slit into webs (32, 34, 36) of smaller width.

23 Claims, 6 Drawing Sheets

APPARATUS AND METHOD FOR SLITTING THIN WEBS

This is a Continuation of U.S. application Ser. No. 08/335,535, filed 07 Nov. 1994 now abandoned.

TECHNICAL FIELD

The invention concerns apparatus and methods for cutting stock materials. More particularly, the invention relates to apparatus and methods for slitting a wide web of thin material, such as film or paper, into a plurality of narrower webs.

BACKGROUND ART

Wide webs of thin material such as paper, plastic and photographic film for some years have been slit to provide a plurality of narrower webs. Typically, this has been done using stationary or rotating knives past which the web has been drawn to force the web into engagement with the knives. An objective of such arrangements has been to cleanly cut the web without causing the web to spread too much due to the thickness of the cutting knives. When the thickness of the cutting knives causes the web to spread too much, the web will tend to tear upstream of the edge of the knife rather that to be cut by engagement with the sharp edge of the knife. Such tearing can cause a ragged edge to be formed and excessive dust to be generated. The edges of the web also tend to abrade as they are drawn past the flanks of the knives above the sharp edge.

Typically, support for the wide web has been provided by a rotating roller having shallow circumferential grooves spaced axially along the roller at distances corresponding to the desired narrower webs to be slit from the web. The knives have penetrated a small distance into the grooves to ensure that the web will be cut despite roller run-out and local deflections of the web away from the knives. In some instances, the roller has had an elastomeric covering which has been very lightly scored by the knives during operation. In other instances, each knife has penetrated rather deeply into an associated groove in the roller to bear against one edge of the groove, thereby increasing the rigidity of the knife and more precisely establishing the knife's lateral position on the roller.

In each of these cases, and particularly the last one just mentioned, the web has been forced to spread itself across an increasingly wider cross section of the knife as the penetration of the knife into the groove has increased. This increased spreading has contributed to the problems of dirt and ragged edges mentioned previously. In addition, use of rollers to support the web during slitting typically has caused a loss of lateral web stability at transport speeds in the range of 500 feet per minute (2,540 mm/sec). At such speeds, particularly with webs of thin material having thicknesses less than 0.001 inch (0.0254 mm), air entrainment between the web and the roller has reduced frictional contact between the two and interfered with the ability of the roller to maintain sufficient traction to steer the web. This typically has led to steering instability, which has caused variability in the slit widths or camber and weave as the web shifted laterally on the support roller. With webs thicker than about 0.001 inch, adjusting the tension in the web generally will alleviate these problems; whereas, with thinner webs, increasing the tension may cause wrinkling and stretching which cannot be tolerated.

An alternative approach is disclosed in British Patent Specification No. 1,030,369 which describes a slitting machine for sheet materials. A stationary tubular member is provided at its outer surface with tangentially extending grooves spaced axially along the member at the desired slit widths. A tangentially oscillating cutting blade extends into each groove. The blades do not contact the grooves. Air under pressure is passed from the interior of the tubular member into the grooves, so that the sheet material is lifted out of contact with the outer surface. A problem with this apparatus is that the web necessarily will tend to deform into the grooves which can cause damage to the newly slit edges. And, since the edge of each knife is positioned within its associated groove, the web is forced to move past the thicker portion of the knife spaced from the cutting edge, which can force the web to spread and abrade unacceptably. Also, since the blades do not contact the grooves and are oscillated during operation, the position of the blades will tend to vary somewhat during operation which can cause uneven slit widths.

Thus, known types of slitting apparatus and methods have been subject to variability in their operation which can cause uneven slit widths and poor edge quality. For particularly thin webs having thicknesses of about 0.00006 inch (0.0015 mm), a need has existed for slitting apparatus and methods which are much less subject to such problems. A need also has existed for improved techniques for guiding such thin webs to and from a slitting apparatus to prevent the web from wandering laterally during the slitting process.

SUMMARY OF THE INVENTION

Our invention provides an improved apparatus and method for razor slitting of webs, with minimal spreading of the webs and attendant defects caused by over engagement of the webs with the razor. The knife or razor is stiffened for improved slit width accuracy by supporting the back of the knife and by tangentially engaging the cutting edge of the knife with an underlying air support element. The apparatus is less prone than prior art devices to web tracking or steering instabilities when passing from one speed to another, due to use of an air support bar at the slitting knives, in combination with upstream and downstream web steering devices which are not sensitive to web speed. Since grooves are not needed for the knives, infinite slit width adjustability is permitted.

An air support element, such as a non-rotating, porous and cylindrical air bar or fixed, flat-surfaced air table, is used to support the web on a film of air. One or more cutting elements, such as knives or razor blades, are tangentially engaged with the surface of the support element, to slit the web into multiple narrower ribbons or webs. The knives preferably are lightly spring loaded against the surface and may have straight or curved cutting edges. The knives may be advanced continuously or intermittently to expose succeeding portions of the web to fresh, sharp edges. The web may be laterally guided very accurately past the support element by various upstream or downstream means, such as edge-guiding air bars, steerable air bars, vented rollers or, uniquely in accordance with one embodiment, an upstream web guiding device and a single vacuum metering drum. Alternatively, due to its unique properties, the air support element may be displaced transversely of the web using a servo system, to maintain the edge of the web at a desired distance from the knives.

The scope of our invention is defined by the claims. One embodiment of our apparatus is well suited for slitting thin webs and includes a non-rotating air support member having a porous surface; means for moving a web past the air support member; means for directing pressurized air to the air support member to float the web above the porous surface; at least one cutting element having a cutting edge; and means for tangentially engaging the cutting edge with the porous surface. As a result of this arrangement, the web is slit by the at least one cutting element as the web floats above the porous surface, engages the cutting element and moves past the air support member. The air support member may be an air bar; the porous surface may be cylindrical; and the means for moving may be positioned to wrap the web through a first angle about the cylindrical surface. The air support member alternatively may be a flat-surfaced air table. The tangentially engaged cutting edge may be straight or curved. The means for moving may comprise a rotatable vacuum metering drum adjacent the air bar, the web being wrapped through a second angle about the metering drum upstream of the air bar, then through the first angle about the cylindrical surface, and then through a third angle about the metering drum downstream of the air bar. A driven, vented roller alternatively may be used to move the web. Alternatively, the means for moving may comprise an edge-guiding air bar or steerable roller upstream of the cylindrical surface. The means for tangentially engaging may comprise at least one spring for resiliently engaging the cutting edge with the cylindrical surface. Means may be included for advancing the cutting edge relative to the cylindrical surface to expose fresh, sharp edge. Means may be provided for moving the air support member and cutting knives transversely relative to the path of movement of the web, to adjust the position of the web relative to the air support member.

In accordance with the method of our invention, a thin web is slit into a plurality of narrower webs by providing a non-rotating air support member having a porous surface; moving a web past the air support member; directing pressurized air to the air support member to float the web above the porous surface; providing at least one cutting element having a cutting edge; and tangentially engaging the cutting edge with the porous surface, whereby the web is slit by the at least one cutting element as the web floats above the porous surface and moves past the air support member. The air support member may be an air bar; the porous surface may be cylindrical; and the web may be guided through a first angle about the cylindrical surface. The moving step may comprise providing a vacuum metering drum adjacent the air bar; and wrapping the web through a second angle about the metering drum upstream of the air bar, then through the first angle about the cylindrical surface, and then through a third angle about the metering drum downstream of the air bar. The metering drum may be replaced by a driven vented roller. Preferably, the cutting edge is resiliently engaged. The method may include a step of advancing the cutting edge relative to the porous surface to expose fresh, sharp edge. The air support member may be moved transversely to the web for proper alignment during slitting.

Our invention offers numerous advantages. Web spread and associated cutting defects are minimized. Stiff support of the knives at their edges and backs provides tighter control of the widths of the narrower, slit webs. The apparatus can be readily accelerated or decelerated from one web speed to another without introducing unmanageable tracking instabilities in the web. The knives are readily repositioned transversely of the wide web to provide virtually infinite adjustment of the widths of the slit webs. Specially designed, expensive knives are not required, it being sufficient to use commercially available, single-edged razor blades.

BRIEF DESCRIPTION OF THE DRAWINGS

The foregoing and other objectives, features and advantages of the invention will be apparent from the following more particular description of the preferred embodiments of the invention, as illustrated in the accompanying drawings.

DESCRIPTION OF THE PREFERRED EMBODIMENTS

Figure 1:
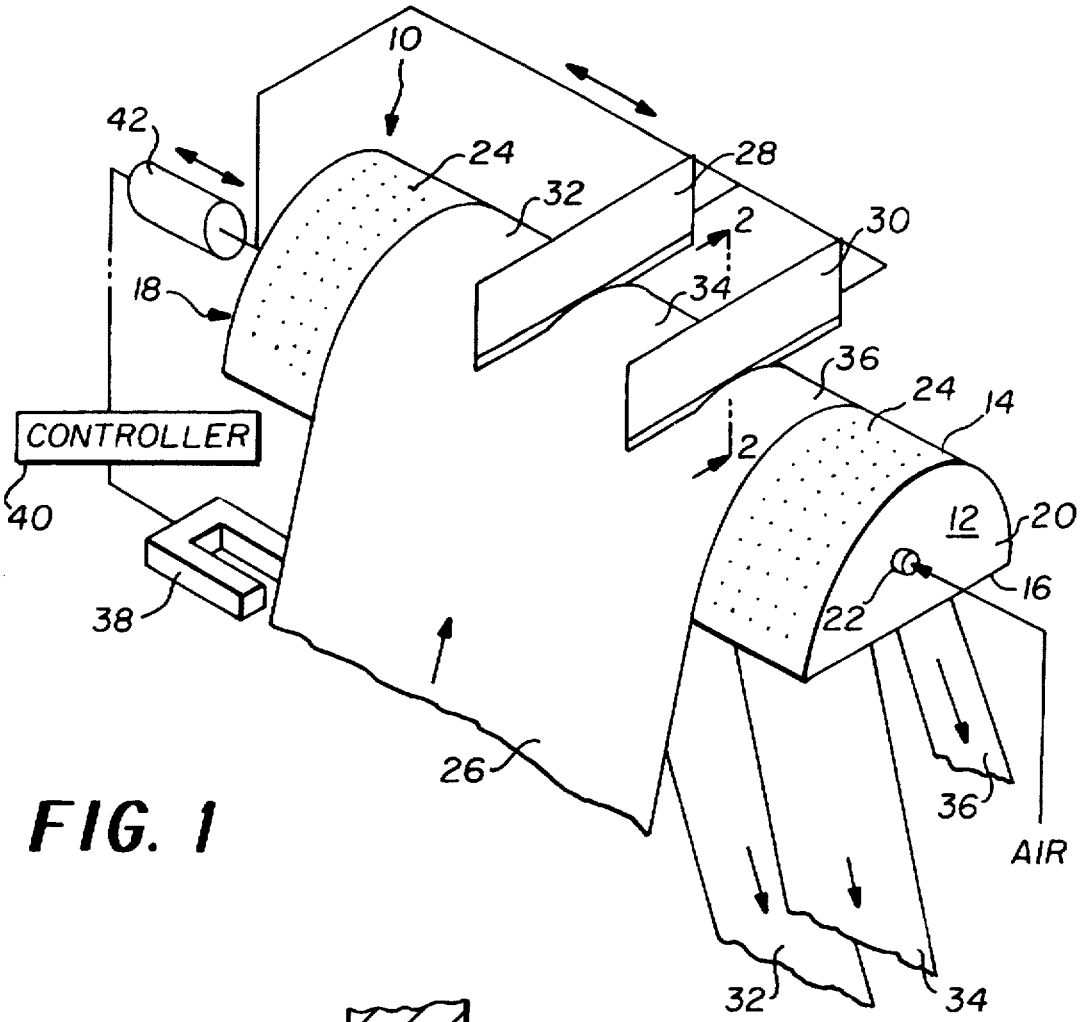
FIG. 1 illustrates a schematic perspective view of an apparatus for slitting webs in accordance with our invention.

The following is a detailed description of the preferred embodiments of the invention, reference being made to the drawings in which the same reference numerals identify the same elements of structure in each of the several Figures.

Figure 2:
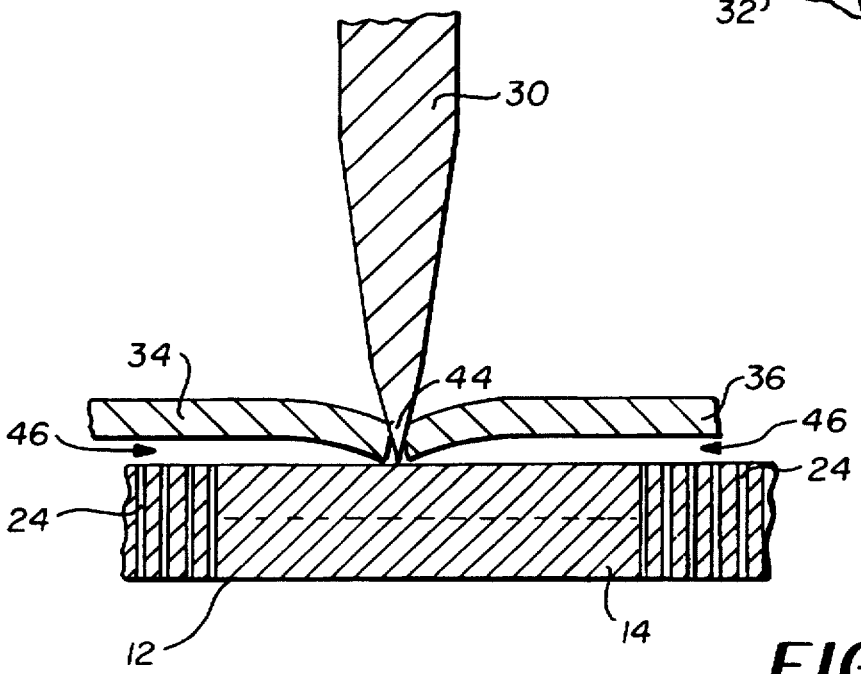
FIG. 2 illustrates an enlarged sectional view along line 2—2 of FIG. 1.
Figure 3:
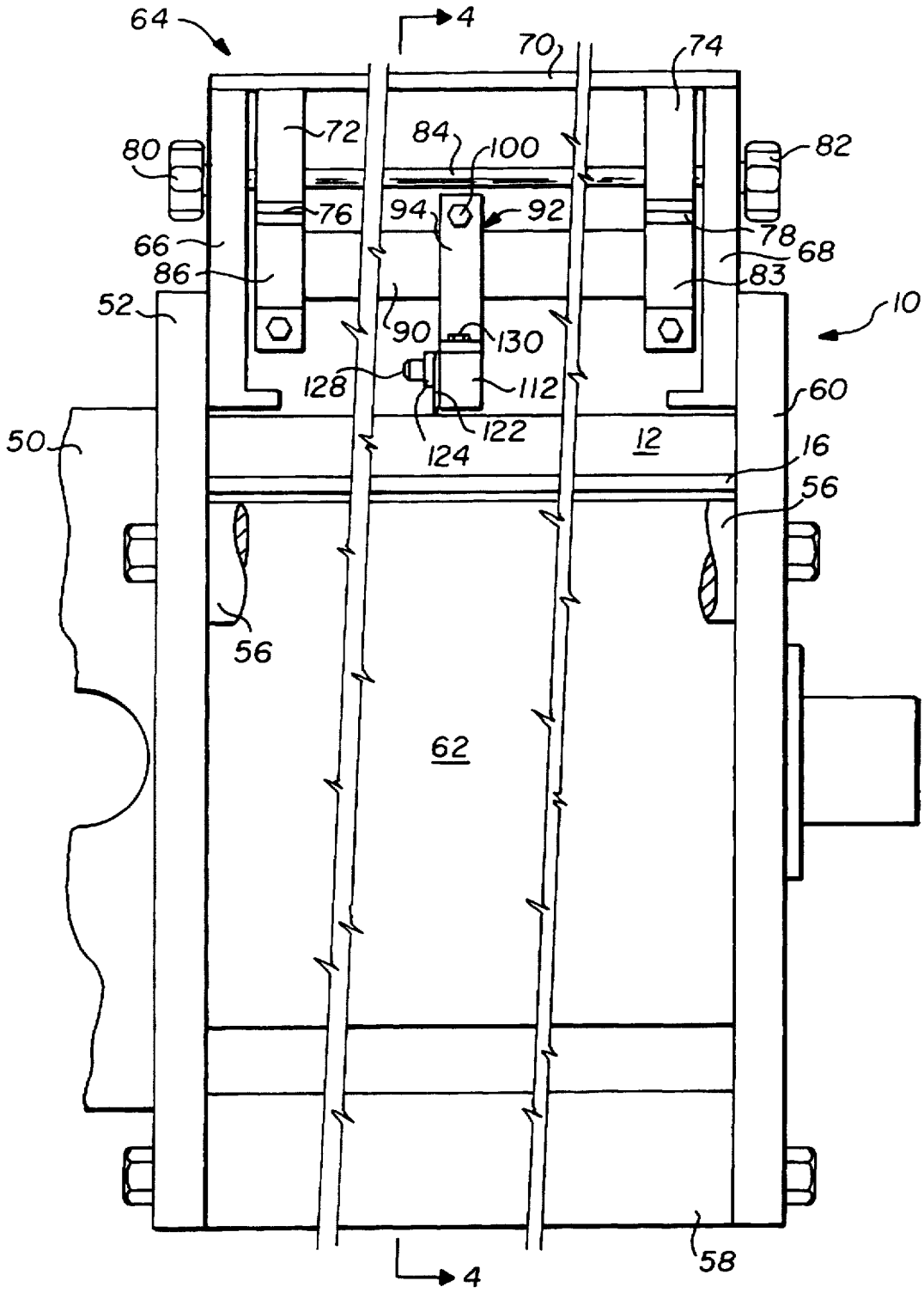
FIG. 3 illustrates an elevation view, partially fragmentary, of an apparatus embodying our invention, without the web being present.
Figure 4:
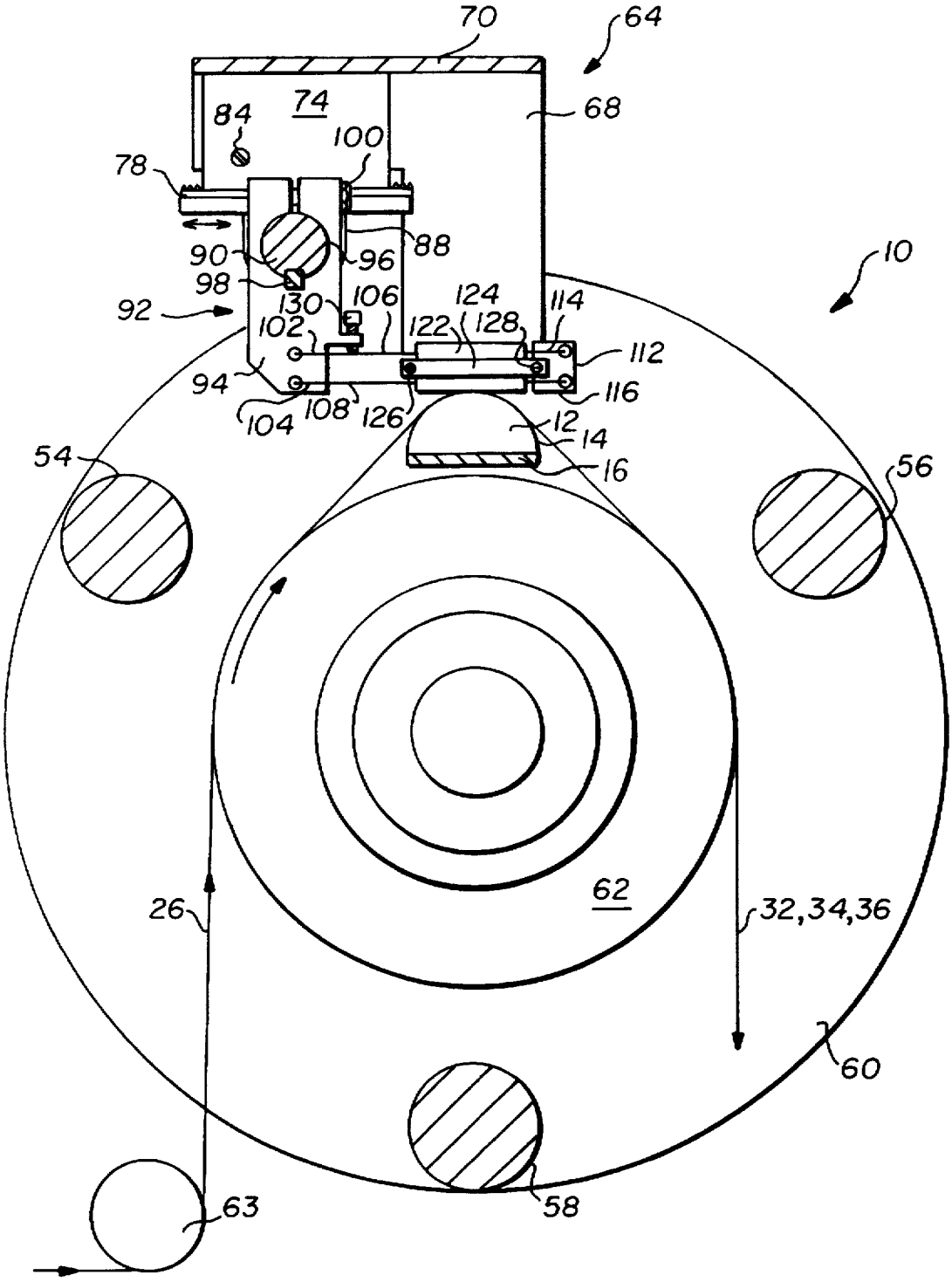
FIG. 4 illustrates a view along line 4—4 of FIG. 3, with the web present.
Figure 5:
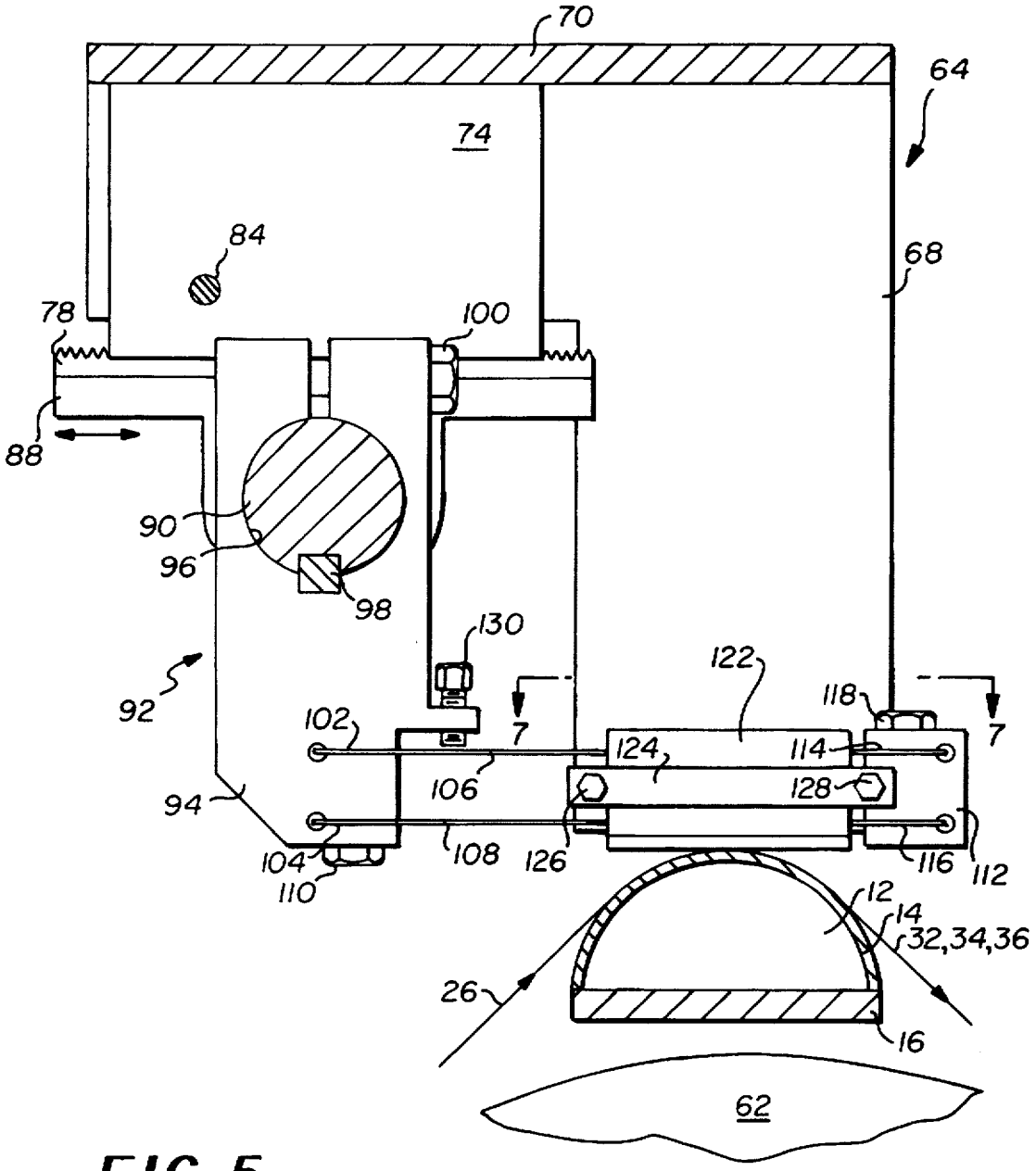
FIG. 5 illustrates an enlarged view of the slitter knife assembly of FIG. 4.

Referring to FIGS. 1 and 2, the basic features and principles of our invention can be understood. An apparatus 10 for slitting wide webs of thin material includes a commercially available type of air bar 12 comprising a half-cylindrical, porous shell 14 having about 2μ pores extending through its thickness. Shell 14 may be fabricated by sintering particles, electroforming or electroetching. A suitable shell would be Model 3020-L made by Mott Metallurgical Corporation of Farmington, Conn. Air bar 12 further comprises a bottom wall 16, end walls 18, 20 and a connector 22 in end wall 20 for pressurized air. As illustrated schematically in FIG. 2, the tiny passages or pores 24 through shell 14 allow air flow through the shell to support a web 26 to be slit. Though only a pair of straight edge razor blades or knives 28, 30 are illustrated, those skilled in the art will appreciate that the number of knives would be chosen in a given instance to be one less than the number of slit webs to be produced. The knives may be made from any suitable material such as steel or ceramics. Each knife 28, 30 is held in with its cutting edge in tangential, essentially point contact with the cylindrical surface of shell 14, with the plane of each knife perpendicular to the axis of the shell and precisely parallel to the direction of movement of web 26. As web 26 is moved past the knives by any convenient web transport system, not illustrated, smaller width slit webs 32, 34, 36 are formed, which are led away from air bar 12 at different angles, as illustrated.

To ensure that web 26 engages the knives at the proper transverse locations on the web, a conventional edge sensor 38 is provided to sense the position of the edge of the incoming web. For example, a conventional, ultrasonic, pulsed dual beam sensor such as an Accuguide Micro 4000 made by Accuweb Inc. of Madison, Wis., may be used. Sensor 38 produces a signal to a conventional programmable controller 40 which, in turn, actuates a conventional linear actuator 42 operatively connected to air bar 12 and knives 28, 30, as indicated schematically. Suitable slides, not illustrated, may be provided to permit air bar 12 and knives 28, 30 to move transversely, thereby enabling actuator 42 to adjust the position of the air bar and knives to account for transverse wandering of the incoming web.

FIG. 2 illustrates how the narrowest part 44 of the knife makes tangential contact with the porous shell 14 of air bar 12; so that, web 26 and slit webs 32, 34, 36 float on a cushion of air 46 on either side of the knives, just off the surface of the air bar. No grooves are needed in the surface of the air bar to receive the edges of the knives, as in some prior art apparatus. Because the web engages the narrowest part of the knives, web spreading is held to a minimum, which improves the quality of the cut edge and reduces the generation of dirt. Conventional, commercially available, single-edged razor blades may be used.

Web 26 may be made, for example, from a material such as polyethylene terephthalate and have any desired width and a thickness in the range of 0.001 inch (0.0254 mm) or less. Excellent slitting has been accomplished, for example, at web speeds as high as 1,000 feet per minute (5,080 mm/sec) and an air pressure of about 5 psi (34.48 kPa) into the previously mentioned shell from Mott Metallurgical Corp., has been found to ensure good slitting when using knives of the type just described and a wrap angle about the air bar of about 90 degrees.

Turning now to FIGS. 3 to 8, a particular embodiment of the apparatus of our invention can be understood. A machine frame 50 supports an end plate 52 from which a trio of cross bars 54, 56, 58 extend perpendicularly to an opposite end plate 60. Rotatably mounted between end plates 52, 60 is a conventional vacuum drum or hug drum 62, which may be of the type disclosed in commonly assigned U.S. Pat. No. 4,998,658. Air bar 12 preferably is mounted directly above vacuum drum 62 between the end plates. When drum 62 has a diameter of about 8.0 inch (203 mm) and shell 14 has a radius of about 1.0 inch (25.4 mm), web 26 may wrap onto drum 62 upstream of the air bar through a wrap angle of about 42 degrees. Web 26 and slit webs 32, 34, 36 may wrap onto the air bar through a wrap angle in the range of 90 degrees. Finally, the slit webs may again wrap onto drum 62 through a wrap angle in the range of 42 to 145 degrees, or may be lead away in the general manner shown in FIG. 1. The length of the free span of web between a tangent to the vacuum drum and a tangent to the air bar should be held to a minimum to avoid wrinkle formation, such as 2 to 3 inches 51 to 76 mm) for components of the sizes just mentioned. A web steering device 63, such as an edge guiding air bar, conventional concave steerable roller or vented roller, is mounted upstream of the vacuum drum, to accurately guide the web onto the vacuum drum.

Positioned above air bar 12 is a slitter knife assembly 64 according to our invention. A pair of inverted, L-shaped end plates 66, 68 are mounted to the inside surfaces of end plates 52, 60, respectively. A top plate 70 extends between and is mounted on the upper edges of end plates 66, 68. Supported beneath top plate 70 near each of end plates 66, 68 are a pair of rack and pinion assemblies 72, 74, having at their lower sides respective movable racks 76, 78. As illustrated, the racks extend in planes perpendicular to the transverse axis of air bar 12. Assemblies 72, 74 comprise respective actuator knobs 80, 82 which share a common transverse shaft 84. The internal components of assemblies 72, 74 are entirely conventional, as will be understood by those skilled in the art, and function upon rotation of knobs 80, 82 to cause the racks to move back and forth as indicated by the arrows in FIGS. 4 to 6. Mounted on the underside of the racks are respective support brackets 86, 88 which fixed grasp the opposite ends of a transverse, round bar 90. Brackets 86, 88 preferably may be loosened to permit bar 90 to rotate to move all knife assemblies 64 toward or away from drum 62.

Mounted on bar 90 are one or more individual slitter heads 92, only one being illustrated for simplicity. Each slitter head comprises a metal body block 94 having a transverse bore 96 slidably receiving bar 90. A key 98 preferably is provided to prevent block 94 from rotating about bar 90. To fix each block 94 at a desired transverse position on bar 90, a clamp bolt 100 is provided across a slot through the side wall of the bore. Below bore 96, a pair of parallel clamping slots 102, 104 are provided for receiving respective ends of a pair of leaf springs 106, 108. A clamp bolt 110 is provided to secure the leaf springs within slots 102, 104. At the opposite ends of the leaf springs, a knife support member 112 is mounted by means of parallel clamping slots 114, 116 which receive the opposite ends. A clamp bolt 118 secures the leaf springs within slots 114, 116.

Figure 6:
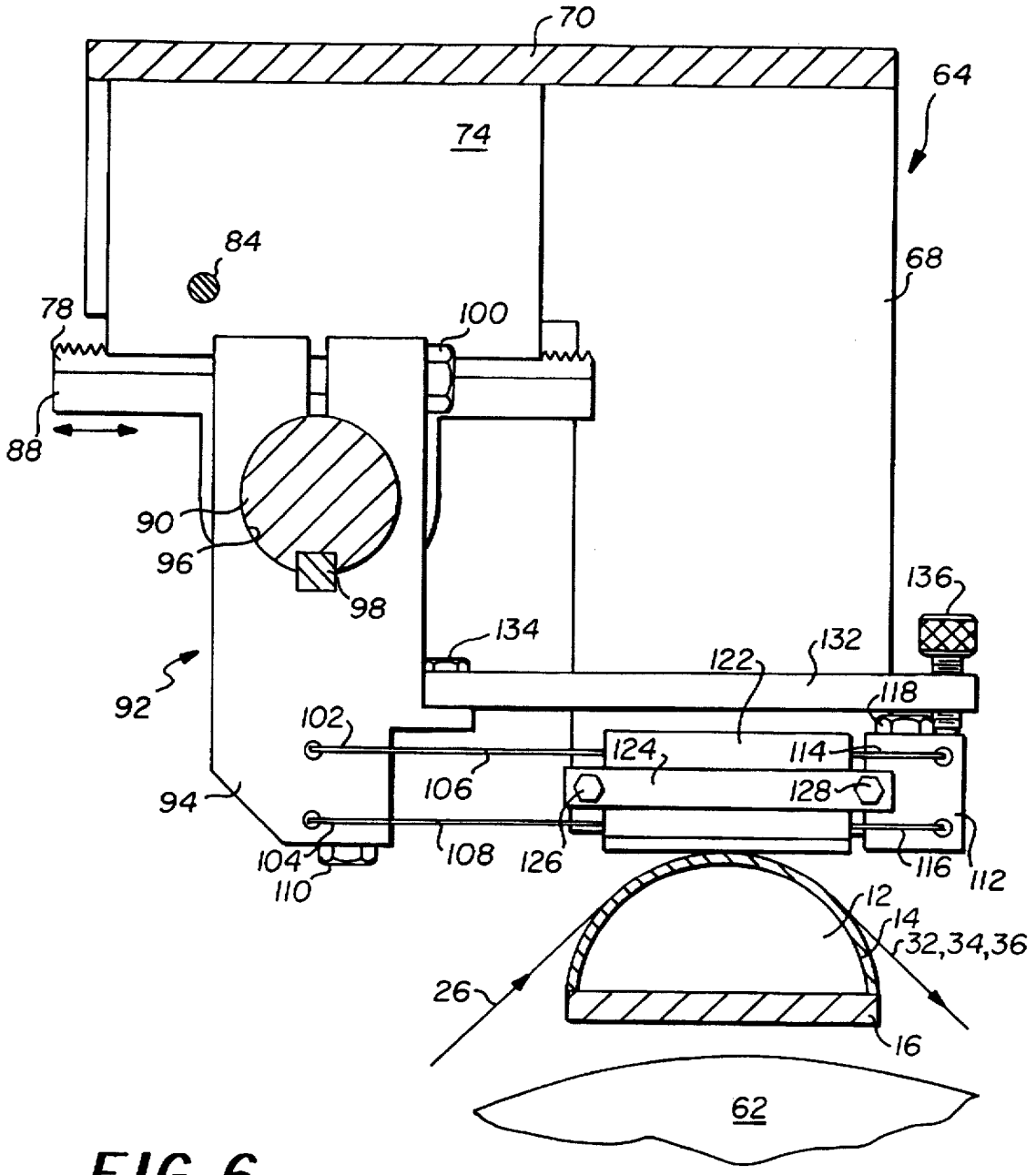
FIG. 6 illustrates an enlarged view of an alternative version of the slitter knife assembly.
Figure 7:
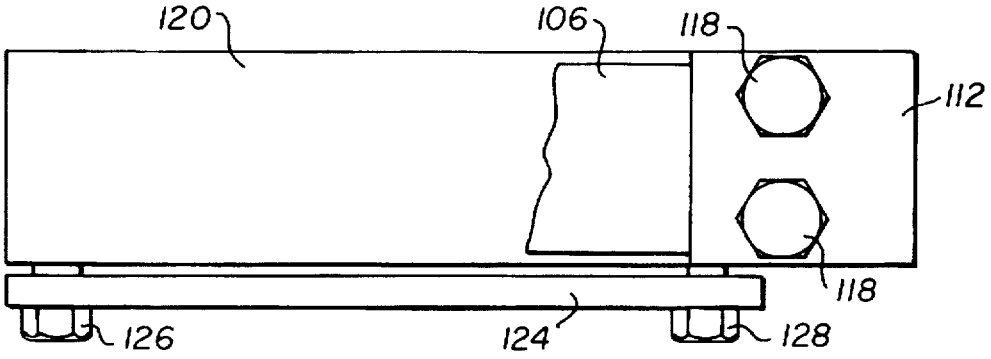
FIG. 7 illustrates an enlarged view, partially fragmentary, along line 7—7 of FIG. 5, with the slitting knife removed.
Figure 8:
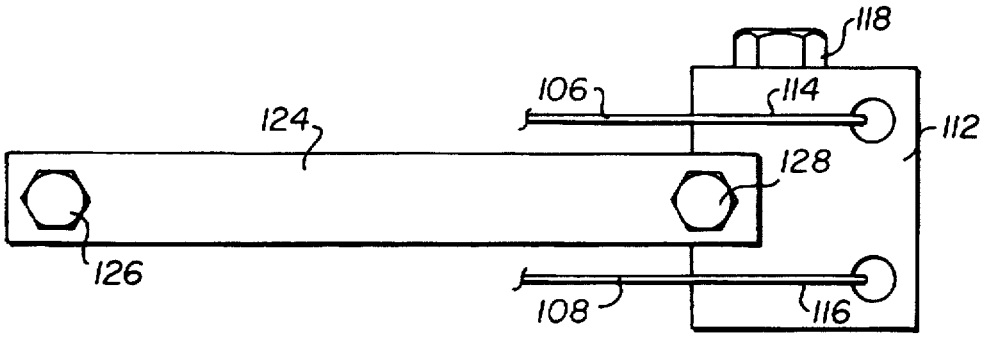
FIG. 8 illustrates an elevation view, partially fragmentary, of the structure of FIG. 7.

As best seen in FIGS. 7 and 8, a knife support finger 120 extends from support member 112 between the leaf springs back toward body block 94. A conventional single edged razor blade or similar knife 122 is held against a side surface of finger 120 by a keeper plate 124 secured by bolts 126, 128. Thus, the edge of knife 122 tangentially engages with air bar 12. The force of engagement should be just sufficient to achieve slitting of the web, but not so great as to deform the knife against the air bar. This may be readily determined by adjusting the force, starting with the knives initially out of contact with a moving web, until satisfactory slitting is achieved. To adjust the force of engagement of the knife with the air bar for slitting webs thinner than 0.00025 inch (0.0064 mm), a bias adjustment bolt 130 may be provided through a lateral flange of body block 94; so that, bolt 130 can be driven into engagement with the upper surface of leaf spring 106 near the body block. Alternatively for thicker webs, as shown in FIG. 6, a cantilevered arm 132 may be mounted to body block 94 by a bolt 134. A fine-pitched stop bolt 136 mounted at the free end of arm 132 can be driven into engagement with the top surface of support member 112 to limit movement of the knife away from the air bar.

The mode of operation of the apparatus of FIGS. 3 to 8 is essentially the same as that of FIGS. 1 and 2. Body blocks 94 may be moved transversely to an infinite number of positions to provide slit webs of many desired widths. Bar 90 may be rotated to place blades 122 in tangential contact with drum 62. Bolt 130 or 134 may be used to adjust the biased force of engagement. Vacuum drum 62 is rotated to move web 26 and slit webs 32, 34, 36 through the apparatus. The webs float over air bar 12 and do not spread unduly upon engagement with the slitting knives. Should the quality of the slit edges decrease, knobs 80, 82 can be rotated incrementally to advance or retract racks 76, 78 to present fresh edge at the point of tangency. It is also within the scope of our invention to automatically drive rack and pinion assemblies 72, 74 to continuously advance the knives, by providing suitable motors, not illustrated, operating under the guidance of controller 40, for example.

Figure 9:
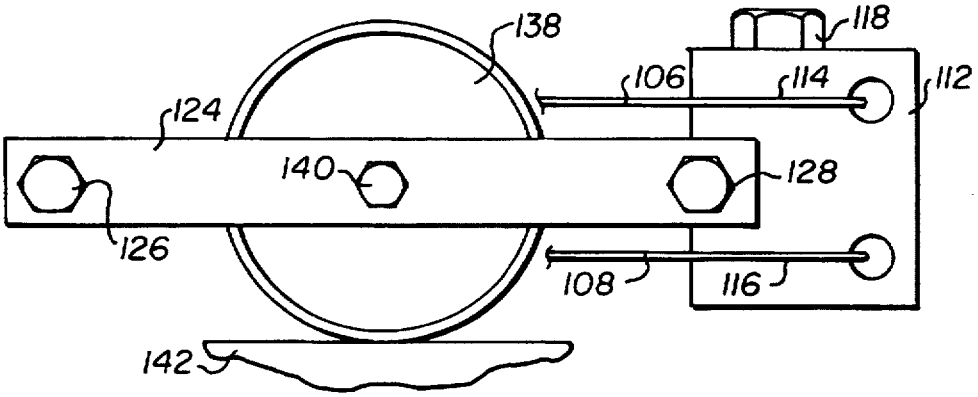
FIG. 9 illustrates an enlarged view of the slitter knife assembly with a circular slitting knife installed.

Although straight-edged knives have been found suitable, our apparatus also may comprise knives with curved edges, such as a disk knife 138 illustrated in FIG. 9. Such a knife may be captured between support finger 120 and keeper bar 124 by an additional bolt 140. By loosening bolts 126, 128, 140, knife 138 may be rotated to expose fresh edge. Such curved edge knives may be used with cylindrical air bar 12 or with a conventional flat-surfaced air table 142, as illustrated schematically in FIG. 9.

Figure 10:
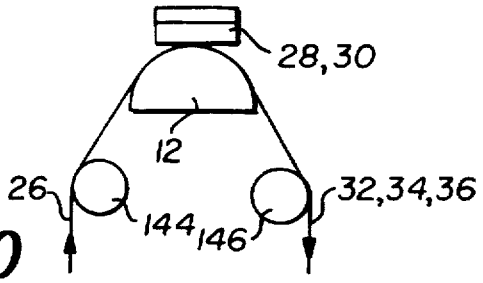
FIG. 10 illustrates schematically an alternative arrangement for guiding a web to and from the air support element.

Although a vacuum drum is particularly useful to move a web to and from the slitting apparatus of our invention, other arrangements will occur to those skilled in the art. For example, as illustrated schematically in FIG. 10, a pair of edge guiding air bars 144, 146 may be provided upstream and downstream of air bar 12, such as the air bars in commonly assigned U.S. Pat. No. 4,892,243. Bars 144, 146 alternatively could be conventional, concave steerable rollers or vented rollers.

Parts List

10 . . . apparatus for slitting
12 . . . air bar
14 . . . half cylindrical shell of 12
16 . . . bottom wall of 12
18, 20 . . . end walls of 12
22 . . . connector for pressurized air
24 . . . passages through 14
26 . . . web to be slit
28, 30 . . . razor blades or knives
32, 34, 36 . . . webs slit from web 26
38 . . . edge position sensor
40 . . . controller
42 . . . linear actuator
44 . . . narrowest part of blade or knife
46 . . . cushion of air to support web 26
50 . . . frame
52 . . . end plate
54, 56, 58 . . . cross bars
60 . . . end plate
62 . . . vacuum drum
63 . . . web steering device
64 . . . slitter knife assembly
66, 68 . . . inverted L-shaped end plate
70 . . . top plate
72, 74 . . . rack and pinion assembly
76, 78 . . . rack
80, 82 . . . adjustment knob for 72, 74
84 . . . transverse shaft linking knobs 80, 82
86, 88 . . . support brackets
90 . . . transverse bar
92 . . . individual slitter head
94 . . . body block
96 . . . bore
98 . . . key between 90 and 96
100 . . . clamp bolt
102, 104 . . . horizontal clamping slots
106, 108 . . . leaf springs
110 . . . clamp bolt
112 . . . knife support member
114, 116 . . . horizontal clamping slots
118 . . . clamp bolt
120 . . . horizontal knife support finger
122 . . . single edged razor blade
124 . . . keeper bar
126, 128 . . . bolts
130 . . . bias adjustment bolt
132 . . . cantilevered arm
134 . . . fine-pitched stop bolt
136 . . . bias adjustment bolt
138 . . . circular knife
140 . . . bolt
142 . . . flat air table
144, 146 . . . edge guiding air bars or steerable rollers While our invention has been shown and described with reference to particular embodiments thereof, those skilled in the art will understand that other variations in form and detail may be made without departing from the scope and spirit of our invention.

Having thus described our invention in sufficient detail to enable those skilled in the art to make and use it, we claim as new and desire to secure Letters Patent for:

1. A method for slitting a thin web, comprising the steps of:

providing a non-rotating air support member having a porous surface with an average pore size of about 2 μm;

moving a thin web past the air support member;

directing pressurized air to the air support member to float the web above the micro-porous surface;

providing at least one non-rotating cutting element having a cutting edge; and supporting the cutting edge against the micro-porous surface such that the cutting edge tangentially engages the micro-porous surface, whereby the thin web is slit by the at least one cutting element as the web floats above the micro-porous surface and moves past the air support member.

2. A method according to claim 1, further comprising the step of guiding the thin web through a first angle about the air support member, the air support member being an air bar, the porous surface being cylindrical.

3. A method according to claim 2, wherein the moving step comprises the steps of:

providing a vacuum metering drum adjacent the air bar; and wrapping the web through a second angle about the metering drum upstream of the air bar, then through the first angle about the cylindrical surface, and then through a third angle about the metering drum downstream of the air bar.

4. A method according to claim 2, further comprising the step of biasing the edge to resiliently engage the porous surface.

5. A method according to claim 2, further comprising the step of advancing the cutting edge relative to the porous surface to expose fresh, sharp edge.

6. A slitting apparatus in combination with a thin traveling web, comprising:

an air support member having an arcuate micro-porous surface;

a rotatable vacuum drum adjacent the air support member;

the thin traveling web wrapped about a first portion of the rotatable vacuum drum, the thin traveling web exiting the rotatable vacuum drum to wrap about the arcuate micro-porous surface, the thin traveling web exiting the arcuate micro-porous surface to wrap a second portion of the rotatable vacuum drum;

means for directing pressurized air to the air support member to float the thin traveling web above the micro-porous surface;

at least one stationary cutting element adjustably supported proximate to the air support member; and a cutting edge integral with the at least one stationary cutting element, the cutting edge tangentially engaging and supported against the arcuate micro-porous surface, the thin traveling web being slit by the at least one stationary cutting element as the thin traveling web floats above the arcuate porous surface, engages the cutting element and moves past the air support member.

7. A method for slitting a traveling web, comprising the steps of:

providing a non-rotating air support member having a micro-porous surface;

engaging the traveling web with a rotatable vacuum drum;

metering movement of the traveling web with the vacuum drum;

disengaging the traveling web from the rotatable vacuum drum;

moving the traveling web across the micro-porous surface;

directing pressurized air to the air support member to float the web above the micro-porous surface;

providing at least one non-rotating cutting element having a cutting edge;

supporting the cutting edge against the micro-porous surface such that the cutting edge tangentially engages the micro-porous surface, whereby the traveling web is slit by the at least one cutting element as the web floats above the micro-porous surface and moves past the air support member;

re-engaging the traveling web with the rotatable vacuum drum.

8. A method for slitting a traveling web, comprising the steps of:

providing a non-rotating air support member having a micro-porous surface;

wrapping the traveling web about a first portion of a rotatable vacuum drum upstream of the non-rotating air support member;

metering movement of the traveling web with the vacuum drum;

disengaging the traveling web from the rotatable vacuum drum;

moving the traveling web across the micro-porous surface;

directing pressurized air to the air support member to float the web above the micro-porous surface;

providing at least one non-rotating cutting element having a cutting edge;

supporting the cutting edge against the micro-porous surface such that the cutting edge tangentially engages the micro-porous surface, whereby the traveling web is slit by the at least one cutting element as the web floats above the micro-porous surface and moves past the air support member thereby generating a traveling slit web;

wrapping the traveling slit web about a second portion of the rotatable vacuum drum downstream of the non-rotating air support member.

9. An apparatus for slitting a thin web, comprising:

an air support member having an arcuate micro-porous surface;

means for moving the thin web past the air support member;

means for directing pressurized air to the air support member to float the thin web above the porous surface;

at least one stationary cutting element adjustably supported proximate to the air support member; and a cutting edge integral with the at least one stationary cutting element, the cutting edge tangentially engaging and supported against the arcuate micro-porous surface, the thin web being slit by the at least one stationary cutting element as the web floats above the arcuate porous surface, engages the cutting element and moves past the air support member.

10. Apparatus according to claim 1, wherein the air support member is an air bar; the porous surface is cylindrical; and the means for moving is positioned to wrap the web through a first angle about the cylindrical surface.

11. Apparatus according to claim 10, wherein the cutting edge is straight.

12. Apparatus according to claim 10, wherein the cutting edge is curved.

13. Apparatus according to claim 10, wherein the means for moving comprises a rotatable vacuum metering drum adjacent the air bar, the web being wrapped through a second angle about the metering drum upstream of the air bar, then through the first angle about the cylindrical surface, and then through a third angle about the metering drum downstream of the air bar.

14. Apparatus according to claim 10, wherein the means for moving comprises an edge-guiding air bar upstream of the cylindrical surface.

15. Apparatus according to claim 10, wherein the means for moving comprises a steerable roller upstream of the cylindrical surface.

16. Apparatus according to claim 10, further comprising at least one spring for biasing the cutting edge to contact the cylindrical surface.

17. Apparatus according to claim 10, further comprising means for advancing the cutting edge relative to the cylindrical surface to expose fresh, sharp edge.

18. Apparatus according to claim 9, wherein the cutting edge is straight.

19. Apparatus according to claim 9, wherein the cutting edge is curved.

20. Apparatus according to claim 9, wherein the means for moving includes an edge-guiding air bar upstream of the air support member.

21. Apparatus according to claim 9, wherein the means for moving includes a steerable roller upstream of the air support member.

22. Apparatus according to claim 9, further comprising at least one spring for biasing the cutting edge to contact the porous surface.

23. Apparatus according to claim 9, further comprising means for moving the air support member transversely to a path of movement of the web.

* * * * *

UNITED STATES PATENT AND TRADEMARK OFFICE

CERTIFICATE OF CORRECTION

PATENT NO. : 5,794,500
DATED : 18 August 1998
INVENTOR(S) : Michael Long et al

It is certified that error appears in the above-identified patent and that said Letters Patent is hereby corrected as shown below:

Column 10, line 11, --Apparatus according to claim 9, wherein...--

Signed and Sealed this

Fifteenth Day of December, 1998

Bruce Lehman

*Attest:*

BRUCE LEHMAN

*Attesting Officer*

*Commissioner of Patents and Trademarks*